US005141377A

United States Patent [19]

Rathert

[11] Patent Number: 5,141,377

[45] Date of Patent: Aug. 25, 1992

[54] BOOK SHAPING AND PRESSING MACHINE

[75] Inventor: Horst Rathert, Minden, Fed. Rep. of Germany

[73] Assignee: Kolbus GmbH & Co. KG, Rahden, Fed. Rep. of Germany

[21] Appl. No.: 482,273

[22] Filed: Feb. 20, 1990

[30] Foreign Application Priority Data

Feb. 24, 1989 [DE] Fed. Rep. of Germany .... P3905767

[51] Int. Cl.[5] ..... B42C 13/00

[52] U.S. Cl. ..... 412/22; 412/29

[58] Field of Search ..... 412/29, 22, 18, 25

[56] References Cited

U.S. PATENT DOCUMENTS

| | | | |
|---|---|---|---|
| 2,755,491 | 7/1956 | Terzuoli et al. | 412/22 |
| 2,878,496 | 3/1959 | Terzuoli et al. | 412/22 |
| 2,921,322 | 1/1960 | Crawley et al. | 412/29 |
| 3,016,550 | 1/1962 | Schramm | 412/22 |
| 3,123,848 | 3/1964 | Smith, Jr. et al. | 412/29 |
| 3,469,270 | 9/1969 | Thorp | 412/22 |
| 3,731,617 | 5/1973 | Hall | 412/29 |
| 4,263,687 | 4/1981 | Ferguson | 412/29 |
| 4,373,985 | 2/1983 | Glendening | 412/29 |

FOREIGN PATENT DOCUMENTS

| | | | |
|---|---|---|---|
| 0384129 | 8/1990 | European Pat. Off. | 412/22 |

*Primary Examiner*—Mark Rosenbaum
*Assistant Examiner*—Hwei-Siu Payer
*Attorney, Agent, or Firm*—Chilton, Alix & Van Kirk

[57] ABSTRACT

A book shaping and pressing machine comprises a plurality of uniformly spaced pressing appliances which are propelled along an endless path, each of these pressing appliances possessing a pair of pressing plates which face each other across a gap that can be varied, their function being in exert pressure on the pages of a book, this pressure being generated through the agency of spring elements, the machine further comprising heated joint-forming appliances which are installed on the pressing appliances, each of these joint-forming appliances possessing a pair of joint-forming rails which face together across a gap that can be varied, their function being to form the book cover joints by impression.

26 Claims, 6 Drawing Sheets

BOOK SHAPING AND PRESSING MACHINE

BACKGROUND OF THE INVENTION (1) Field of the Invention

The invention relates to a book shaping and pressing machine comprising a plurality of uniformly spaced pressing appliances which are propelled along an endless path, each of these pressing appliances possessing a pair of pressing plates which face each other across a gap that can be varied, their function being to exert pressure on the pages of a book, this pressure being generated through the agency of spring elements, the machine further comprising heated joint-forming appliances which are installed on the pressing appliances, each of these joint-forming appliances possessing a pair of joint-forming rails which face each other across a gap that can be varied, their function being to form the book cover joints.

(2) Description of the Prior Art

In the manufacture of books on a commercial scale, the final operations performed on a book take place on a shaping and pressing machine, these being the operations in which the book cover joints are formed and the book is pressed over its entire area.

Both these operations are performed immediately after the casing-in operation, in which the book block is fitted into the book cover, and they not only endow the book with its aesthetically pleasing shape, but are the operations which primarily decide the quality of the book.

It is common knowledge that water-soluble adhesives are utilized in the casing-in operation, in which the book block is fitted into the book cover, and pressing the book causes the water component of the adhesive to migrate into the book cover and end leaves during the adhesive-setting process, so as to evaporate there. The function of a book shaping and pressing machine is to cause the adhesive to set within an extremely short period of time, this being accomplished by means of the pressing devices and requiring the application of very high pressing forces via pressing plates. The application of pressure is accompanied by smoothing of the materials through which moisture has penetrated as a result of the application of adhesive, the purpose of this smoothing being to keep these materials free of blisters and creases. The book cover joints are formed in the book-shaping device of the book shaping and pressing machine concurrently with the pressing operation. The formation of these cover joints is accomplished by means of heated profiled tools which act on the book cover surfacing material between the inserted spine and the cover boards. These profiled tools are often called "joint burn-in rails".

These profiled tools are intended to bring about thorough warming of the surfacing material, and consequently to render it more deformable in order to produce a durable joint-hinge profile, and this thorough warming is also desired in order to produce a strong adhesive bond between the book block and book cover in the region of the joint hinges. Adequate heated-tool contact time is decisively important with regard both to forming the joint hinges and to the setting of the adhesive that is applied relatively thickly in the joint region during the casing-in operation. A book shaping and pressing machine that operates on a succession of books is disclosed in German Patent 1,207,334, this machine comprising a rotary head that is movable about a vertical axis, the periphery of this rotary head carrying a plurality of pressing appliances, each possessing a pair of pressing plates which face each other. Through the agency of the rotary head, the pressing appliances, moving and stopping in turns, enter successive processing stations in which joint burn-in appliances are located, each comprising a pair of burn-in jaws which face each other. The pressure exerted on the pages of the books is maintained during the cyclic, start-stop movement of the books through the individual processing stations, and in each station the joint burn-in device is closed once per cycle, so as to form the book cover hinges and to subject these regions to the action of heat. The pressing appliances can be individually adjusted to suit books of different thicknesses, adjustment being performed by shifting the outer pressing plates over a set of surface serrations on the end portions of supporting rods.

In a further development of the above-described book shaping and pressing machine, the joint burn-in appliances are located on the pressing appliances, and are cycled onwards together with them, moving and stopping in turns. The joint burn-in jaws can consequently be kept closed during the rotary movement, thus making more time available for the heat to act on the cover material.

A machine of this more advanced design, called also a "joint burn-in and pressing machine", is described in an article in the periodical "Deutscher Drucker", No. 33/6-9-73, page 10, Cols. 3 and 4. In this article, emphasis is placed on the fact that it is particularly important, especially when working with heat-sensitive cover materials, for the machine to be capable of operating with the burn-in rails at a relatively low temperature, and this capability is guaranteed by the number of processing stations.

However, in a joint burn-in and pressing machine of the above-described generic type, the range of book through-put is severely restricted by the fixed number of individual stations that is decisively important as regards the quality of the books, in association with the necessarily intermittent mode of operation involving inter-station transport. Because of its lack of flexibility, the machine is not extendable, and an increase in the number of processing stations would mean a basically new machine, and this would be possible, if at all, only within very narrow limits, owing to the large inertia forces. In addition to this problem, there would also be a considerably greater requirement for non-utilizable floor area.

German Patent 1,804,644 discloses a book press with pressing and creasing stations that are arranged in a straight line. In this book press, the pressing and creasing stations are installed in two parallel channels or passages, so as to increase production. In addition, a conveying system, situated between the pressing plates and the creasing tools, continuously holds the books in a clamped condition while each is pressed and the creases are impressed into it. Through the agency of actuating arrangements, the pressing plates and creasing tools can be moved in order that their displacement relative to one another at particular times is such that they bear against the side surfaces of the books, and against those areas of the books which are to be shaped. The transport system of the apparatus of German Patent 1,804,644 performs a pressing operation on those areas of the books not gripped by the pressing plates. In applications involving book covers with delicate surfacing materials, and especially in cases involving lacquered or cellophane-surfaced covers, there is no way of suppressing markings in the transition zone between the transport system rails and the pressing plates.

The operations in which the books, leaving an upline machine in a single stream, are transferred into the twin-channel arrangement, and in which they are subsequently spaced one from another and introduced into a downline machine, necessitate the use of additional conveying systems, which are expensive to construct.

Moreover, in the straight-line twin-channel configuration, the book press can be utilized only for a restricted range of outputs. One the one hand, this disadvantage is inherent in the start-stop mode of operation, necessarily involving inter-station transport, and while in theory there is no limit to the number of processing stations, increasing the number of stations would entail a floor area requirement that could not be justified.

SUMMARY OF THE INVENTION

The primary object of the invention is to produce a generic-type book shaping and pressing machine which enables a substantial increase in operating speed to be achieved, as well as a qualitative improvement in the forming of the book cover joints and the pressing of the book over its entire area. Over and above these advantages, the pressing appliances associated with the book shaping and pressing machine of the invention are designed to be capable of the entire-area pressing of books of different thicknesses without having to be adjusted, and the associated joint-forming appliances are likewise designed to cope with books of different thicknesses without adjustment.

The above-stated primary object of the invention is achieved by means of a design wherein the pressing appliances, with the joint-forming appliances, can be continuously propelled along an endless path with direction-changing points, preferably by means of an endless conveyor which runs around two reversing wheels, the inner pressing plate of each pressing appliance running along the endless path of the conveyor in guides, and the outer pressing plate of each pressing appliance being movable, parallel with the inner plate, in the sense of varying the gap between the two plates. Apparatus in accordance with the invention also comprises means, acting on the outer pressing plate, for closing the pressing plates and generating a compression force between them and means, acting on the outer pressing plate, for relieving the compression force and opening the pressing appliance. A drive is also provided for actuating the joint-forming rails in the sense of varying the gap between them.

In accordance with a preferred embodiment, a shaping and pressing machine comprises a pressing appliance which consists of an inner pressing plate and an outer pressing plate with supporting rods that are guided in the inner pressing plate, compression springs being disposed between the inner pressing plate and limiting devices which are located at the ends of the supporting rods. The function of the springs is to apply a pulling force to urge the outer pressing plate towards the inner pressing plate. The pressing appliance is characterized, according to a further feature of the invention, by compression springs between the inner pressing plate and a yoke that connects the supporting rods, these compression springs generating a force for holding the books, by spring elements which act on the outer pressing plate and apply a compression force to the books, and by a force-transmitting arrangement which, starting from a cam path, acts via a pressure body in order to apply the pressing stroke to the spring elements, this force-transmitting arrangement being capable of being brought, by automatic means responsive to the book thickness, into a condition in which it exerts a locking action by means of a self-locking catch mechanism. In addition, it is possible to provide adjustability of the effective pressing stroke which the force-transmitting arrangement exerts on the catch mechanism.

The book shaping and pressing machine according to the invention offers the advantage of great variability with regard to pressing and joint-forming. The machine can be extended to any capacity that may be desired, and this enables it to meet all requirements, especially with regard to output. Uniform joint-forming results are guaranteed by the precise movement of the joint-forming rails, in conjunction with the automatic temperature control. The time between insertion and delivery is available to the machine for the entire-area pressing and joint-forming operations. The available time can be increased by increasing the number of pressing appliances and associated joint-forming appliances, and the system can consequently be matched to the production cycle rate. The entire-area pressing and the joint-forming functions are independent of each other, and this allows absolute freedom to vary the sequence and duration of the two functions. The joint-forming and pressing forces can also be built up in several steps.

The joint-forming rails of a machine in accordance with the invention are controlled in relation to the pressing plates, the movements of both joint-forming rails relative to the pressing plates being equal, which guarantees symmetrical joint formation. The depth to which the joint is formed can be set in a definitive manner and the joint-forming stroke can be generated smoothly on the straight-line insertion section and, in addition, on the straight-line delivery section as well.

BRIEF DESCRIPTION OF THE DRAWINGS

The present invention may be better understood and its numerous objects and advantages will become apparent to those skilled in the art by reference to the accompanying drawings wherein like reference numerals refer to like elements in the several figures and in which.

DESCRIPTION OF THE DISCLOSED EMBODIMENT

Figure 1:
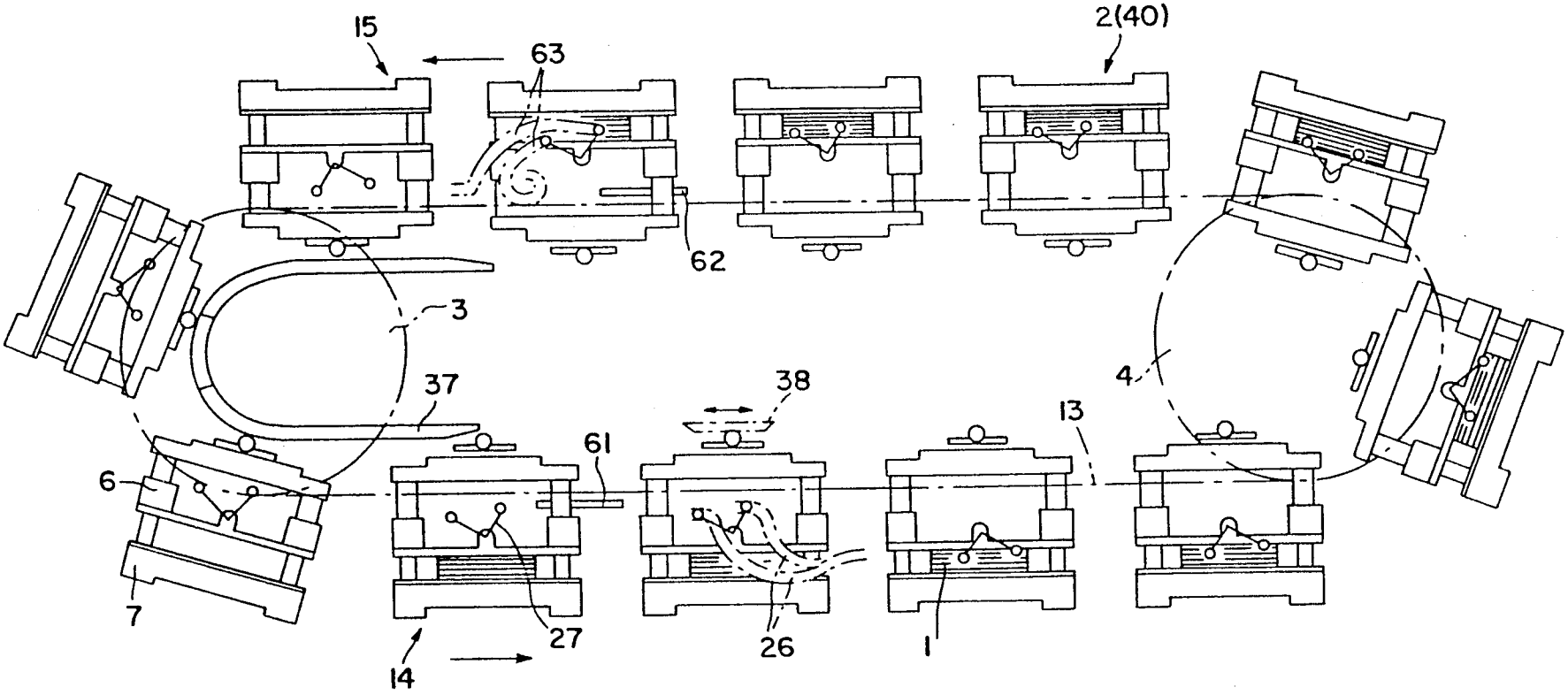
FIG. 1 is a diagrammatic, reduced-scale plan view of a book shaping and pressing machine in accordance with a first embodiment of the invention.

As FIG. 1 shows, a book shaping and pressing machine according to the invention comprises a plurality of uniformly spaced pressing appliance 2, each possessing a pair of pressing plates which face each other across a gap that can be varied, their function being to exert pressure on the pages of a book. Heated joint-forming appliances 40 are located on the pressing appliances, each joint-forming appliance possessing a pair of joint-forming rails which face each other across a gap that can be varied, their function being to impress the book cover joints.

The pressing appliances 2, with their associated joint-forming appliances 40, are series-articulated by virtue of being located on an endless chain conveyor 13, which runs around reversing chainwheels 3 and 4, and which continuously propels said appliances.

During their orbiting movement within the oval transport system defined by conveyor 13, the pressing appliances 2, with the associated joint-forming appliances 40, have to perform the functions of pressing a book 1 over its entire area and of forming the joints, the latter operation sometimes being called "joint burn-in". The books 1 are delivered to the machine at a first station 14 on one of the straight-line sections of the transport system, and are discharged at an oppositely disposed station 15 on the other straight-line section. The transit time between insertion at station 14 and release at station 15 is available for the entire-area pressing and joint-forming operations.

Figure 2:
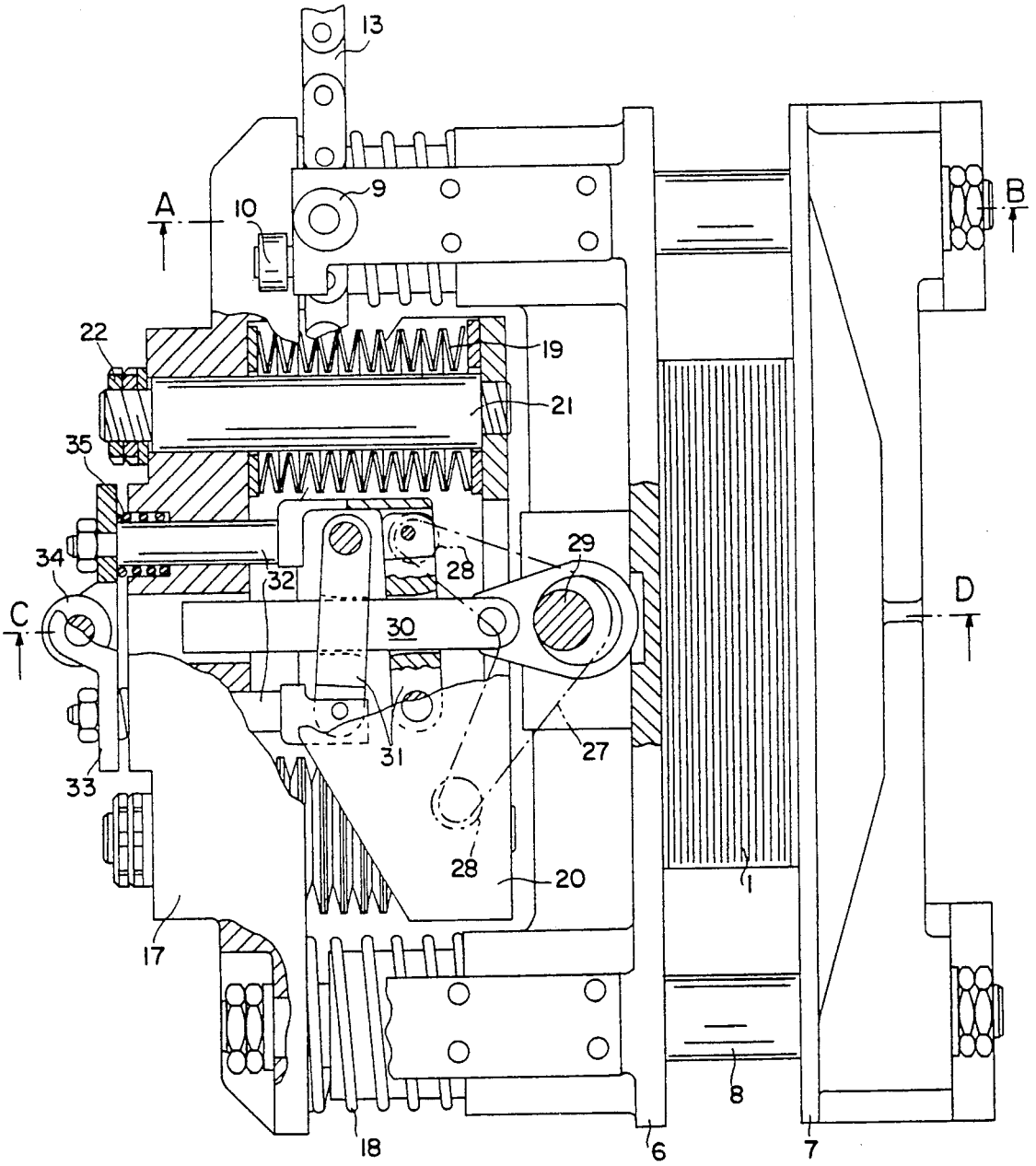
FIG. 2 shows a plan view of a pressing appliance associated with the machine of FIG. 1.
Figure 3:
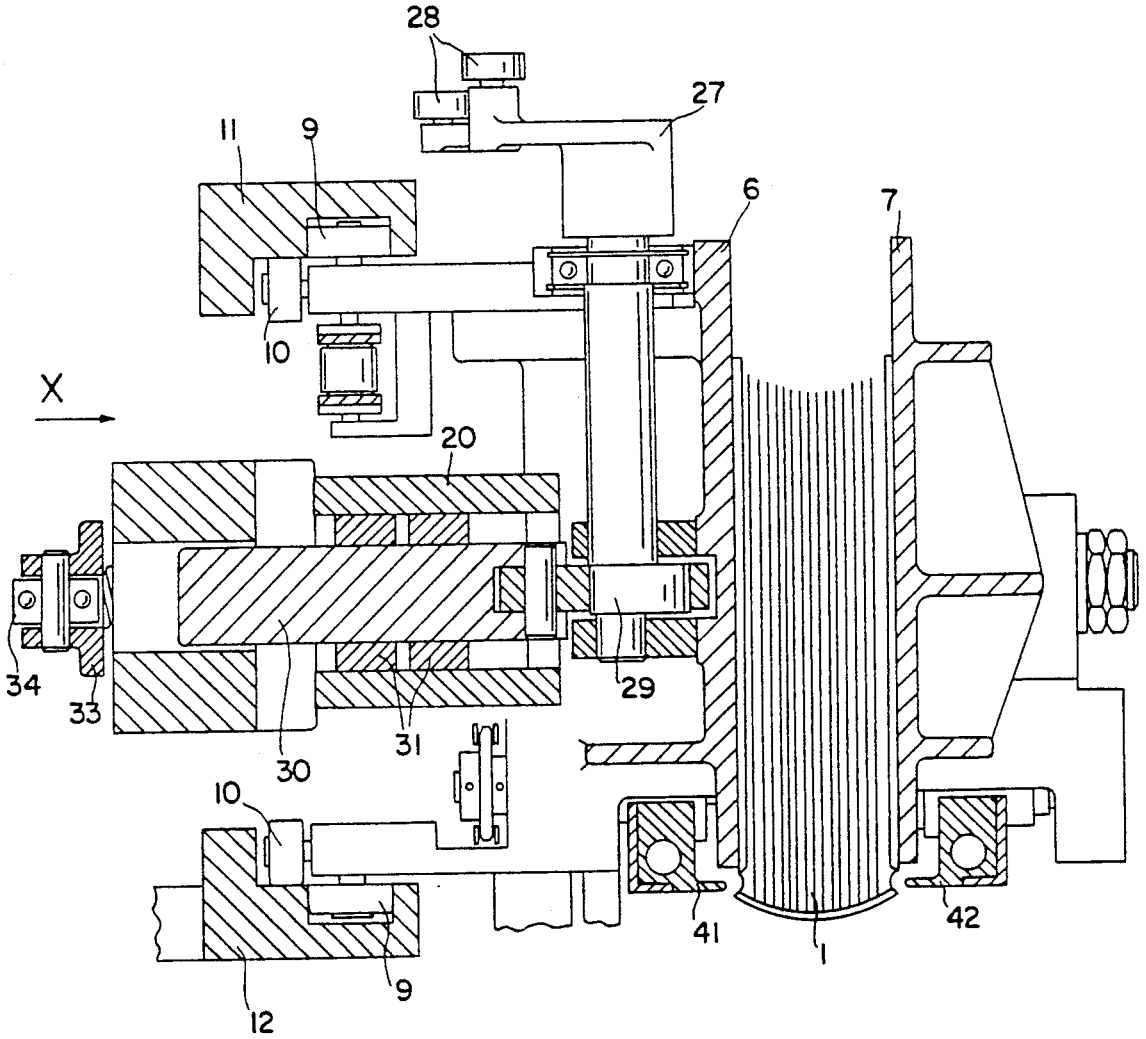
FIG. 3 shows the pressing appliance with associated joint-forming appliance, the drawing corresponding to the section line C-D in FIG. 2.
Figure 4:
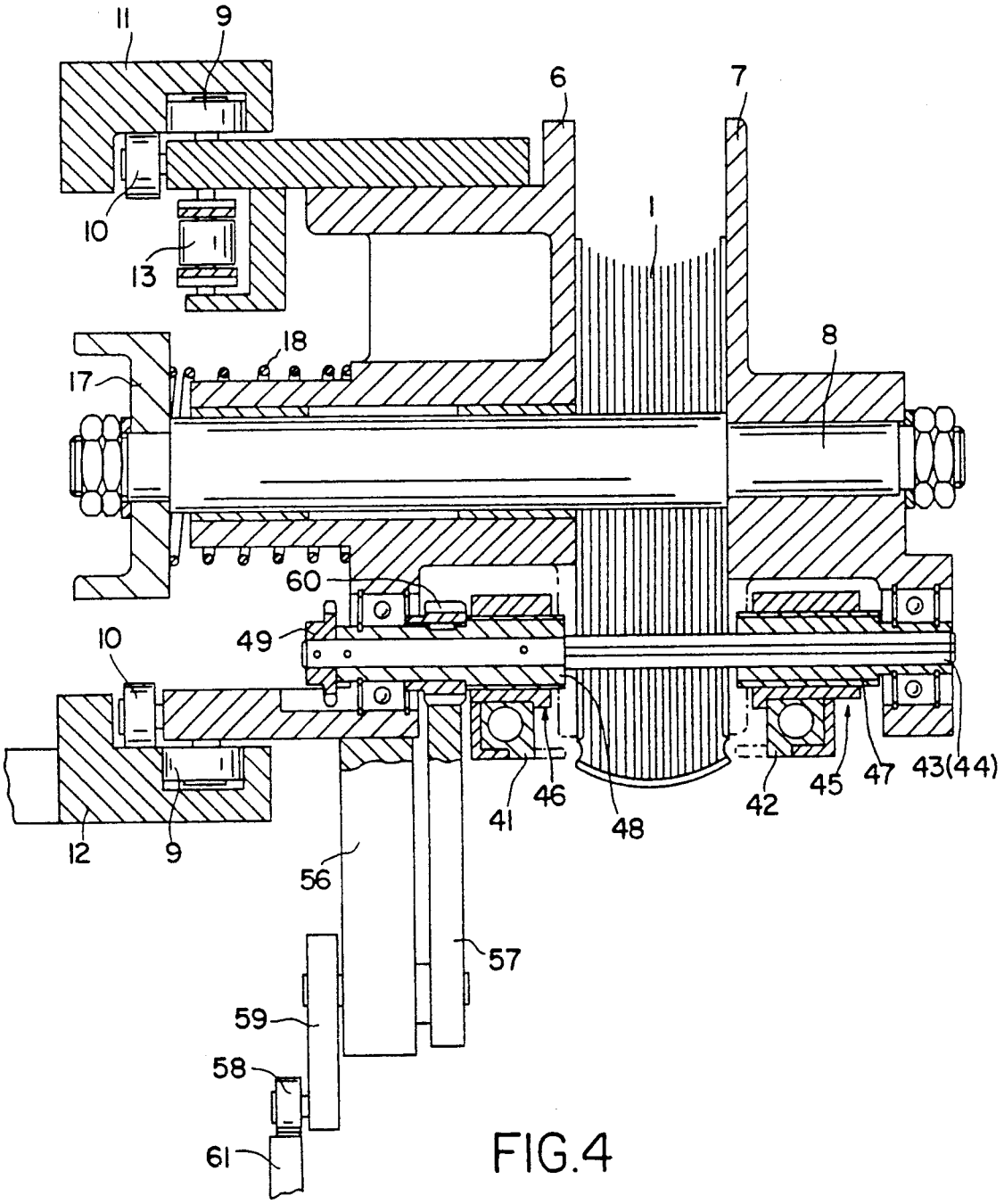
FIG. 4 shows the pressing appliance with associated joint-forming appliance, the drawing corresponding to the section line A-B in FIG. 2.
Figure 5:
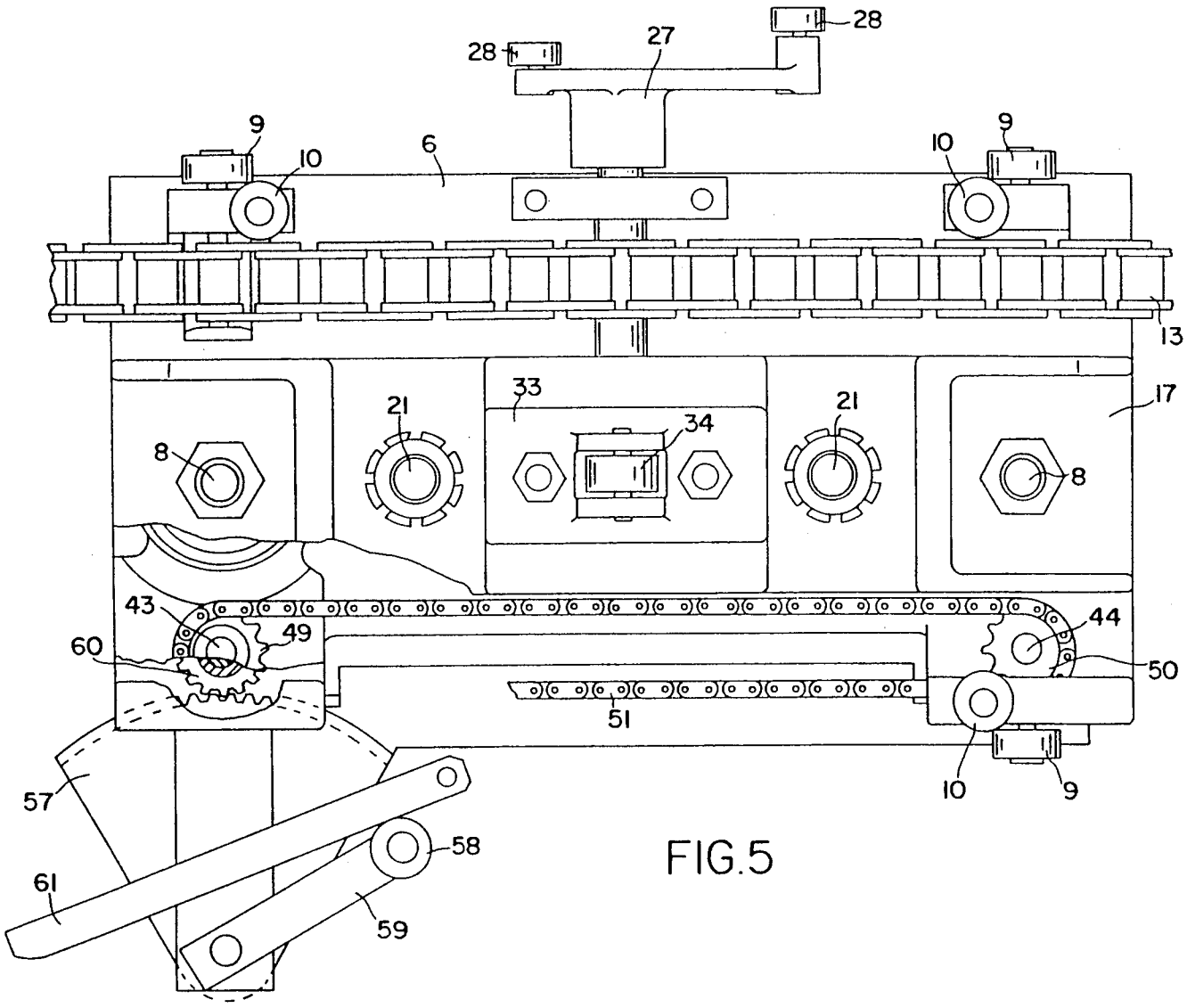
FIG. 5 shows a view in the direction indicated by the arrow X in FIG. 3.

Referring to FIGS. 2–4, each pressing appliance 2 consists of an inner pressing plate 6 and an outer pressing plate 7 which are interconnected by supporting rods 8. The outer pressing plate 7 is guided in the inner pressing plate 6 and is movable, parallel with it, in the sense of varying the gap between the two plates.

Pilot rollers 9 and 10, each duplicated top and bottom, are supported from the inner pressing plate 6 and run in endless guideways 11 and 12 associated with a machine frame. The rollers 9 are arranged horizontally and the rollers 10 are arranged vertically. The pressing plates 6 and 7 are propelled along their endless path in a known manner, through the agency of the chain 13, to which the inner pressing plates 6 are linked.

As FIG. 2 shows particularly clearly, the free ends of the supporting rods 8 are interconnected by a yoke 17. Springs 18 are located on the supporting rods 8, between yoke 17 and the rear of the inner pressing plate 6, so as to apply a force which pulls the outer pressing plate 7 towards the inner pressing plate 6. The springs 18 are designed to be sufficiently strong to generate a force for holding the books 1 between the pressing plates 6 and 7.

Two disk-spring assemblies 19, which serve to apply a compression force to the books 1, are preloaded between a pressure body 20 and the yoke 17. For this purpose, the disk-spring assemblies 19 are located on guide pins 21, fastened at first ends within the pressure body 20, which extend through the yoke 17 while being freely slidable within it. Pins 21 are held in contact with the rear face of the yoke 17 through the agency of end stops 22.

The pressing stroke is applied to the disk-spring assemblies 19 via the pressure body 20, and its generation starts from two cam paths 26 (FIG. 1), proceeds via a bent lever 27, with pilot rollers 28 installed thereon, and via an eccentric assembly 29, mounted in the inner pressing plate 6, to a self-locking catch mechanism which is housed within the pressure body 20. The catch mechanism is brought, by automatic means controlled by the thickness of the book currently present, into a condition in which it exerts a locking action.

The catch mechanism comprises a force-transmitting bar 30 and locking elements 31. Bar 30 is articulated to the eccentric assembly 29 and can be slidably displaced by said assembly in the axial direction. The locking elements 31 are rotatable from an unlocking position, wherein free axial sliding of the force-transmitting bar 30 is allowed, into a locking position, wherein free axial sliding of said bar 30 is inhibited as a result of tilting the locking elements 31 to the positions shown in FIG. 2. In order to obtain this locking/unlocking action, the locking elements 31 are mounted directly opposite each other in the pressure body 20, and pull rods 32 engage with their free ends. The pull rods 32 extend through the yoke 17 while being freely slidable within it, and are connected at their ends to a pressure plate 33 which carries a pilot roller 34. The locking elements 31 are held in the locking position, in which they are tilted towards each other, through the agency of the pressure plate 33 and compression springs 35 which are disposed between the pressure plate 33 and the yoke 17. Elements 31 can be rotated into the unlocking position through the agency of a control track 38 (FIG. 1) which acts on the pilot roller 34 associated with the pressure plate 33, counter to the action of the compression springs 35.

Figure 6:
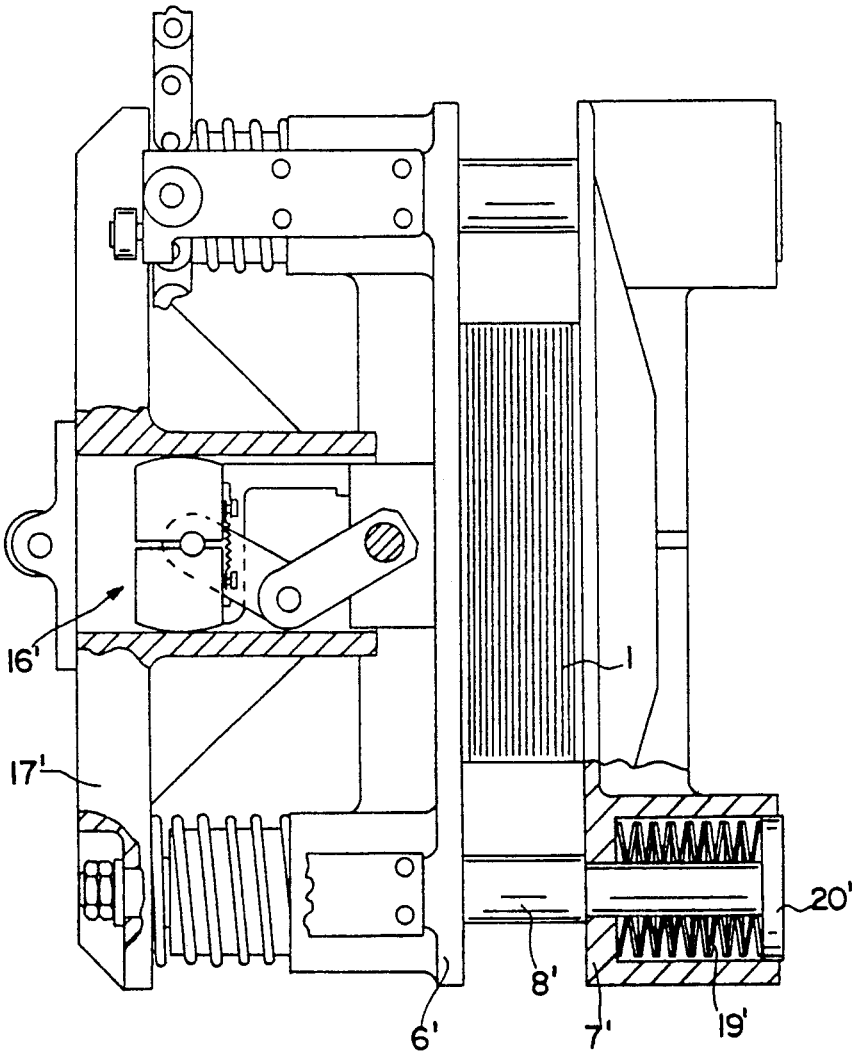
FIG. 6 shows a modified embodiment of the pressing appliance.

In a modified embodiment, shown in FIG. 6, the spring elements 19' which generate the compression force can act on the outer pressing plate 7' directly from the outside, via pressure bodies 20' located at the ends of the supporting rods 8' the pressing plate 7' being movable on the supporting rods 8' in the axial direction counter to the action of the spring 19'. A self-locking catch mechanism 16', functionally connected to the force-transmitting arrangement 27–29 is installed within the yoke 17'.

The pressing appliance is held open to a defined extent, exceeding the book thickness, by a control track 37 in the direction-reversing zone between book ejection at station 15 and book insertion at station 14. This hold-open action occurs as a result of the pilot roller 34, which is associated with the pressure plate 33, running onto the control track 37 and pressing the pressure plate 33 against the yoke 17. Having regard to different book thicknesses, the control track 37 is inwardly and outwardly repositionable by means of adjusters.

A transfer facility in which the preformed books 1 are held —not shown in any Figure—is located upline of the book shaping and pressing machine, and moves in synchronism with the pressing appliances 2 for short periods of time. This transfer facility firmly holds the incoming books, which are moving obliquely upwards, until they arrive between the pressing plates 6 and 7. Thereafter, the pressing appliance closes as the pilot roller 34 runs clear of the control track 37 and, at the same time, the outer pressing plate 7 is pulled towards the inner pressing plate 6 with a relatively light force for holding the book. This light force, generated by the springs 18, suffices for book transport. This light holding force acts independently of the entire-area pressing and joint-forming functions.

When the pilot roller 34 is guided clear of the control track 37, the locking elements 31 are shifted to the tilted, locking position through the agency of the pull rods 32, and this causes the force-transmitting bar 30 to be locked within the locking elements 31.

Starting from the two cam paths 26, into which the pilot rollers 28 associated with the bent lever 27 run during the orbiting movement of the pressing appliance, the force required for pressing the book 1 is transmitted via the eccentric assembly 29. When the force-transmitting bar 30 is locked within the locking elements 31, through the agency of the pressure body 20 and the disk-spring assemblies 19, the outer pressing plate 7 is pulled against the book 1 and the compression force is consequently generated. The two cam paths 26 can be installed at any position on the endless path of the conveyor 13.

In order to enable the pressing stroke, and with it the compression force, to be varied for different book sizes or different materials, means are provided for adjusting the effective pressing stroke that is executed through the agency of the bent lever 27 with the pilot rollers 28. For this purpose, the locking elements 31 are shifted to the unlocked position by a control track 38, acting via the pilot roller 34, the pressure plate 33 and the pull rods 32. The control track 38 is, moreover, positioned relative to the two cam paths 26, in the direction of movement through the machine, in a manner such that the effective pressing stroke of the lever 27 with the pilot rollers 28 becomes smaller, although the lever 27 executes the full stroke. The portion of the stroke which takes place while the catch mechanism is in the unlocked position is ineffective: only the remainder of the stroke, subsequent to restoration of the locking action, being effective. Moreover, the stroke of the bent lever 27 with the pilot rollers 28 takes place in two movement phases, namely in a first, ineffective phase initiated through the agency of the control track 38, and thereafter in a second movement phase, subsequent to activation of the catch mechanism, the stroke always continuing as far as the dead center position of the eccentric. The size of the effective stroke determines the compression force resulting from deflection of the disk-spring assemblies 19.

In order to open the pressing appliance so as to release the book 1 after completion of the joint-forming and entire-area pressing operations, cam paths 63, into which the pilot rollers 28 run, are provided on the ejection side of the book shaping and pressing machine. Entry of rollers 28 into said cam paths reverses the eccentric assembly 29 and relieves the load on the disk-spring assemblies 19. The pilot roller 34 subsequently runs onto the control track 37, and this causes the locking elements 31 to be shifted to their unlocking position so as to release the force-transmitting bar 30. Release of the book 1 to a discharge facility occurs as a result of the pressure plate 33 bearing against the yoke 17 and inward movement counter to the action of the compression springs 18. In the downstream facility—not shown in any Figure—the book 1 is grasped, acquired from the pressing appliance 2, and guided out on a path which runs obliquely downwards.

The control track 38, which cancels the locking of the force-transmitting bar 30 can, with the associated cam paths 26, be installed at any position on the endless path of the conveyor 13.

A plurality of control tracks 38, with associated cam paths 26 for generating the pressing stroke, can also be installed between the insertion and discharge stations respectively indicated at 14 and 15, as can a plurality of cam paths 63 for relieving the load on the spring elements 19. When an arrangement of this kind is provided, its design can be such that the pressing stroke is increased in a stepwise manner.

As will be obvious from the foregoing, a book shaping and pressing machine according to the invention allows absolute freedom to vary the pressing force, as well as the duration and frequency of pressing.

As mentioned above, heated joint-forming appliances 40, with automatic temperature control, are located on the pressing plates 6 and 7. These appliances consist of the joint-forming jaws 41 and 42. Jaws 41 and 42 are carried by two spindles 43 and 44, which are rotatably mounted in the pressing plates 6 and 7 at locations spaced a certain distance apart. Jaws 41 and 42 are movable relative to the pressing plates 6 and 7, in the sense of varying the jaw gap, through the agency of shifting devices 45 and 46, the shifting devices being provided with self-holding threads. The heating elements of the joint-forming jaws 41 and 42 receive electrical power from a multiple-output supply apparatus of a known type.

The joint-forming rail 41 on the inner pressing plate 6 is carried by threaded sleeves 48, which are fastened to the spindles 43 and 44, while the joint-forming rail 42 on the outer pressing plate is located on threaded sleeves 47. Sleeves 47 are freely slidable on the spindles 43 and 44 in the axial direction, as well as being secured to these spindles in a manner such that twisting cannot occur. As a result of this arrangement, the joint-forming rail 42 can be adjusted to suit different book sizes, together with the outer pressing plate 7.

The two spaced spindles 43 and 44 are drivably interconnected via sprockets 49, 50 and a chain 51.

The drive for moving the joint-forming rails 41 and 42 in order to impress the book cover joints is transmitted to a pinion 60 on the threaded sleeve 48, via an actuating lever 59 with a pilot roller 58, and via a toothed quadrant 57 which is rotatably mounted on a bracket arm 56 associated with the inner pressing plate 6, and which meshes with said pinion. In order to control the closing movement of the joint-forming rails 41 and 42, a control track 61 is provided in the entry zone of the transport system of the book shaping and pressing machine, the pilot roller 58 associated with the actuating lever 59 contacting this control track 61 during the orbiting movement.

The joint-forming operation preferably begins before the entire-area pressing operation. In the starting position, the joint-forming rails 41 and 42 are situated behind the pressing-plate plane, and they can be moved inwards, through the agency of the control track 61, up to the pressing-plate plane. The movement takes place in parallel fashion, symmetrically from the outside and the inside, and the book joints are formed to a uniform depth as it proceeds.

In order to allow for the creep behavior of the paper, the movement of the joint-forming rails 41 and 42 preferably takes place slowly, and this calls for a long control track 61, its total inclination setting corresponding to the depth to which the joints are formed. To limit the joint-forming pressure, provision can be made for installing the tracks 61 on mountings which exhibit spring-resilience in the vertical direction.

The joint-forming pressure can be built up in several steps, and the joint-forming stroke is determined by the inclination of the control track 61. At the same time, it is possible to arrange for the joint-forming stroke to take place in a continuous manner, on the straight-line book insertion section of the transport system, and also on the first portion of the straight-line discharge section as well. There is the possibility of installing an additional control track on the discharge side, so as to increase the depth to which the book cover joints are formed.

A control track 62 is situated immediately ahead of the cam paths 63 and the control track 37 for opening the pressing appliance. The pilot roller 58 associated with the actuating lever 59 runs onto control track 62 and thereby causes the joint-forming rails 41 and 42 to be opened.

In a modified embodiment, the joint-forming rails 41 and 42 can be utilized as a facility for separating the books from the pressing plates 6 and 7, this being accomplished through the agency of an appropriately configured control track which causes the joint-forming rails 41 and 42 to execute an additional inward stroke as the pressing plates 6 and 7 open, and thus to push the book clear to the pressing plates. The joint-forming rails 41 and 42 are afterwards retracted again, back to their starting positions behind the pressing-plate defined planes.

The joint-forming rails 41 and 42 are actuated through the agency of control tracks of simple design, which are easy to reposition, and to reset to alter their inclination.

As in the case of the pressing appliances 2, the joint-forming appliances 40 also embody absolute variability with regard to the joint-forming pressure, joint-forming time, and sequence.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A book shaping and pressing apparatus comprising a plurality of uniformly spaced pressing means, each of said pressing means comprising an inner pressing plate and an outer pressing plate, said plates facing each other across a gap, the outer pressing plate of each said pressing means being supported from and movable with the inner pressing plate in a first direction and relative to the inner pressing plate in a second direction to reduce the gap between the two plates, first spring means mounted on said pressing means for causing said pressing plates to exert clamping pressure on a book, said first spring means resiliently biasing said outer pressing plate toward said inner pressing plate, said apparatus further comprising heated joint-forming means, said joint-forming means being installed on each of said pressing means, each of said joint-forming means comprising a pair of joint-forming rails, the rails of each said pair of joint-forming rails facing each other across a gap that can be varied, drive means coupled to each of said pressing means for continuously propelling said pressing means, said drive means including stationary guide means for defining an endless path of movement for the inner pressing plate of each pressing means, means in part mounted on said pressing means and acting on the outer pressing plate of each pressing means for generating a compressive force for application to a clamped book whereby the gap between the pressing plates will be reduced, said compressive force being superimposed on the clamping pressure along at least a first preselected portion of said path, means positioned along said path downstream of said first preselected portion of said path and cooperating with said compressive force generating means for relieving the said compressive force and enlarging the gap between the pressing plates, and first means for actuating the joint-forming rails to vary the gap therebetween, said first actuating means being in part mounted on said pressing means and reducing the gap between said joint-forming rails along a portion of said path.

2. The apparatus of claim 1 wherein each outer pressing plate is mounted on supporting rods that are guided in an associated inner pressing plate, said supporting rods being interconnected by a yoke, said first spring means of each pressing means being positioned between said inner pressing plate and said yoke, said first spring means applying a force to urge the outer pressing plate toward the inner pressing plate to generate a book holding force, said compressive force generating means comprising second spring means, said compressive force generating means further comprising force-transmitting means for applying the pressing force of said second spring means between said inner plate and said yoke, said force-transmitting means including first cam means which moves with said pressing means and a first stationary cam track positioned along said path for cooperation with said first cam means, said compressive force generating means further comprising self-locking catch means whereby said force-transmitting means may be brought into a locked position to define an effective pressing stroke.

3. The apparatus of claim 2 wherein said second spring means comprise disk-spring assemblies.

4. The apparatus of claim 2 wherein said second spring means acts on the outer pressing plate via said yoke, wherein said force transmitting means includes a pressure body disposed between said second spring means and said inner pressing plate, and wherein said self-locking catch means is at least in part housed within said pressure body.

5. The apparatus of claim 4 wherein the compressive force generated by said second spring means is applied directly to an outer pressing plate via a said pressure body, the pressure body being located at the end of a said supporting rod, the outer pressing plate being movable on the supporting rod in the axial direction counter to the action of said second spring means.

6. The apparatus of any one of claims 2 to 5 further comprising means for adjusting the effective pressing stroke defined by said catch means, said adjusting means being located at a preselected position along said path and operatively engaging said catch means.

7. The apparatus of claim 2 wherein said catch means comprises at least a first locking element and wherein said force-transmitting means further comprises a force transmitting bar, said locking element cooperating with said force-transmitting bar to define a locked condition of said catch means, the relative position of said locking element on said bar at said locked condition determining the effective pressing stroke, the effective pressing stroke being adjustable by axially sliding said force-transmitting bar relative to said locking element when said catch means is in the unlocked condition, said apparatus further comprising control means for determining the condition of said catch means, said control means comprising a first control track and second actuating means which couples said locking element to said first control track.

8. The apparatus of claim 7 wherein said locking element is immobilized by engaging said force-transmitting bar as a result of tilting, said second actuating means comprising at least a first pull rod which engages said locking element at a region thereof displaced from said bar, said second actuating means further comprising a pressure plate which carries a first pilot roller, said first pilot roller contracting said first control track, said first pull rod being connected to said pressure plate, said second actuating means also comprising third spring means positioned between said pressure plate and said yoke, said locking element being held in the locked condition by the force applied to said pressure plate by said third spring means, said locking element being brought into the unlocked condition by the cooperation between said first control track and said first pilot roller.

9. The apparatus of claim 8 wherein said first control track can be repositioned along said path relative to said first cam track to vary the effective pressing stroke that is generated.

10. The apparatus of claim 7 wherein said force-transmitting means further includes an eccentric assembly which couples said force-transmitting bar to said inner pressing plate, said eccentric assembly comprising a lever, said first cam means comprising at least a second pilot roller operatively connected to said lever, said first cam track being engaged by said second pilot roller.

11. The apparatus of claim 10 wherein said path has a book insertion position and a book ejection position and wherein said first control track and said first cam track are positioned along said path between the insertion position and the ejection position.

12. The apparatus of claim 11 wherein said means for relieving the said compressive force comprises a second cam track positioned ahead of the ejection position, said second pilot roller engaging said second cam track in order to impart movement to said lever of said eccentric assembly in a direction which will relieve the load on said second spring means.

13. The apparatus of claim 11 further comprising means for repetitively reducing the gap between the pressing plates as a clamped book travels between the insertion position and the ejection position, said repetitive gap reducing means comprising a plurality of further control tracks positioned generally downstream in the direction of book travel with respect to said first control track for cooperation with said second actuating means, and a plurality of further cam tracks for cooperation with said second pilot rollers.

14. The apparatus of claim 13 wherein said further control tracks and cam tracks are positioned and configured to increase the effective pressing stroke in a stepwise manner.

15. The apparatus of claim 11 wherein at least a portion of said first control track is positioned in a direction-reversing zone of said path between the delivery position and the insertion position, said first control track cooperating with each said first pilot roller to cause the outer pressing plates to be urged away from the inner plates so as to open the gap therebetween and to hold the said gap open to an extent such that a defined gap exists between an outer pressing plate and an inner pressing plate, said hold-open action occurring through cooperation between said pressure plate and said first pilot roller, said pressure plate bearing against the yoke counter to the action of said third spring means.

16. The apparatus of claim 15 further comprising means for adjusting the position of said first control track.

17. The apparatus of claim 1 wherein said joint-forming rails of each pressing means are movably supported from respective of said pressing plates and wherein said first actuating means causes said joint-forming rails to move symmetrically relative to the pressing plates to vary the gap between said rails.

18. The apparatus of claim 17 wherein said joint-forming rails are each supported by spindles which are rotatably mounted in a said pressing plate at locations spaced by a defined distance.

19. The apparatus of claim 18 wherein the joint-forming rail supported from each inner pressing plate is affixed to first threaded sleeves, said first threaded sleeves being fastened to the said spindles, and wherein the joint-forming rails supported from each outer pressing plate is affixed to second threaded sleeves, said second threaded sleeves being freely slidable on said spindles in the axial direction, said second sleeves being restrained against twisting relative to said spindles.

20. The apparatus of claim 19 wherein said spindles of each pressing means are interconnected via a chain drive, and wherein said first actuating means comprises joint formation control tracks and a rail actuation roller which engages said joint formation control tracks, said first actuating means further comprising a rail actuation control lever connected to said rail actuation roller and gear means for coupling said rail actuation control lever to ne of said spindles, the reduction of the gap between said joint-forming rails being initiated by a first joint formation control track, and the opening of the joint-forming rails being initiated by a second joint formation control track.

21. The apparatus of claim 20 wherein at least said first joint formation control track is installed on mountings which exhibit spring-resilience in a plane defined by the direction of movement of said rails during the reduction of the gap therebetween.

22. The apparatus of claim 20 wherein said path has a book insertion position and a book ejection position and wherein said joint formation control tracks are positioned along said path between the book insertion position and the book ejection position.

23. The apparatus of claim 22 wherein said second joint formation control track is positioned and configured to cause said joint-forming rails to execute an additional stroke in the direction of reducing the gap therebetween as the pressing plates open, so as to separate the book from the pressing plates.

24. The apparatus of claim 22 further comprising at least a third joint formation control track for causing the reduction of the gap between said joint-forming rails whereby the depth to which the book cover joints are impressed may be increased beyond that caused by the first joint formation control track.

25. The apparatus of claim 24 wherein said first joint formation control track defines an inclined cam for operation of said rail actuation roller and the inclination of said inclined cam can be varied.

26. The apparatus of claim 24 wherein said first and third joint formation control tracks have an effective length for causing reduction of the gap between said joint-forming rails and wherein said apparatus further comprises means for altering said effective length.

* * * * *